United States Patent [19]

Morgan

[11] 4,169,727

[45] Oct. 2, 1979

[54] ALLOY OF SILICON AND GALLIUM ARSENIDE

[75] Inventor: Weldon B. Morgan, Garland, Tex.

[73] Assignee: Morgan Semiconductor, Inc., Garland, Tex.

[21] Appl. No.: 901,522

[22] Filed: May 1, 1978

[51] Int. Cl.[2] ..... H01L 21/18

[52] U.S. Cl. ..... 75/134 T; 75/134 S; 75/134 P; 148/33; 252/62.3 GA

[58] Field of Search ..... 75/134 T, 134 P, 134 S; 148/33; 252/62.3 GA; 423/324, 111; 156/60

[56] References Cited

U.S. PATENT DOCUMENTS

| | | | |
|---|---|---|---|
| 2,778,802 | 1/1957 | Willardson et al. | 252/62.3 GA |
| 3,318,669 | 5/1967 | Folberth | 75/134 P |
| 3,344,071 | 9/1967 | Cronin | 252/62.3 GA |
| 3,615,203 | 10/1971 | Kaneko et al. | 148/171 X |
| 3,630,906 | 12/1971 | Willardson et al. | 75/134 T |
| 3,705,825 | 12/1972 | Touchy et al. | 148/171 X |
| 3,826,700 | 7/1974 | Chu | 148/33 X |
| 3,979,271 | 9/1976 | Noreika et al. | 75/134 P |

*Primary Examiner*—G. Ozaki

*Attorney, Agent, or Firm*—Jack A. Kanz

[57] ABSTRACT

Disclosed is a single phase crystalline alloy of silicon and gallium arsenide and methods of making same. The alloy is compounded by reacting elemental gallium, arsenic and silicon in the atomic stoichiometry desired to produce a material which is transmissive in the infrared wavelengths.

6 Claims, No Drawings

ALLOY OF SILICON AND GALLIUM ARSENIDE

This invention relates to a composition of matter comprising silicon and gallium arsenide. More particularly, it relates to a single phase crystalline alloy of silicon and gallium arsenide and methods for making same.

Various infrared systems have been devised wherein an infrared sensor or array of sensors is used in airborne apparatus for infrared imaging, mapping, etc. In many applications the infrared sensors must be protected from the surrounding environment. The protection encasement, therefore, must contain a window panel through which infrared energy is transmitted to the sensors.

Various materials which are highly transmissive in the infrared wavelengths are available and may be used in some applications. However, in airborne applications, particularly wherein the sensors are carried in supersonic aircraft, the environment places stringent requirements upon the materials used for the window panel. For example, in a aircraft travelling at Mach 2.0, the skin temperature of the aircraft may reach temperatures in excess of 200° C. Furthermore, the window panel will be exposed to a harsh environment, such as rain, ice, etc., rapid temperature changes, and must withstand frequent and rapid pressure changes.

Germanium is well known for its transmission of infrared energy and may be formed into window panels of a suitable size to protect infrared sensing equipment from the external environment. However, germanium is a relatively soft material and erodes rapidly when the aircraft carrying a germanium window encounters weather such as rain, etc. Furthermore, germanium is somewhat brittle and is subject to fracture. Furthermore, because the bandgap of germanium is only 0.6 eV, germanium may become highly absorptive in the infrared wavelengths at elevated temperatures.

Silicon has been considered as an alternative material for use as an infrared window panel. Silicon offers the advantages of being much harder than germanium, thus is not subject to severe rain or weather erosion. Silicon is also light and not as brittle as germanium. Therefore, in structural characteristics, it is suitable for use as an infrared window panel for airborne applications. Since silicon has a bandgap of 1.1 eV, it remains transmissive up to 200° or higher. However, the infrared wavelengths of most concern are from about 8 microns to about 12 microns. Unfortunately, silicon has an absorption band at 9.0 microns, thus rendering it less than desirable for an infrared window panel material.

Intrinsic gallium arsenide transmits well in the 8 to 12 micron and has a bandgap of 1.4 eV. Therefore, this material has suitable thermal and optical characteristics for use as an infrared window. However, gallium arsenide is comparatively expensive and fragile. Furthermore, gallium arsenide is not as hard as silicon and is somewhat subject to rain and weather erosion.

In accordance with the present invention, a single phase crystalline alloy material is provided which has a bandgap between 1.1 eV and 1.4 eV, thus is acceptable for use as an infrared window at relatively high temperatures. The material is an alloy of silicon and gallium arsenide compounded in a single phase crystalline structure. The alloy may contain from less than 5 atomic percent to about 50 atomic percent silicon. The alloy of the invention provides an infrared transmissive material which is relatively inexpensive, lightweight and extremely hard. The material is not subject to weather erosion and is not brittle, therefore is an exceptionally suitable material for an infrared window panel for use in adverse environments at high temperatures.

The silicon and gallium arsenide alloy may be readily compounded and formed into windows as large as 20" by 24" or larger if desired and is relatively transmissive in the infrared.

The alloy may be compounded using elemental gallium, arsenic and silicon or using a gallium arsenide compound and silicon. The constituents in the desired stoichiometric amounts are placed in an inert container such as quartz. In the preferred practice, high purity elemental arsenic, gallium and silicon are placed in a quartz container of the size and dimensions of the desired window panel and enclosed in an inert container such as quartz. The container is flushed with inert gas such as helium or argon, evacuated and backfilled with inert gas to a pressure slightly less than atmospheric. The container is then uniformly heated to about 1300° C. or until the entire composition is molten. If desired, the molten composition may be slightly agitated as by rocking the container to assure homogenous mixing. Heating is then terminated and the molten composition allowed to cool to room temperature.

It should be observed that although the melting point of silicon is 1470° C. and the melting point of gallium arsenide is 1247° C., the composition need only be heated to a temperature where reaction occurs. The melting point of the alloy will be determined, of course, by the composition. However, the melting point should be less than 1470° C. After the alloy window panel blank is formed, it may be polished and coated with dielectric anti-reflectance coatings by conventional methods.

Since the bandgap of silicon is 1.1 eV and the bandgap of gallium arsenide is 1.4 eV, the bandgap of the alloy will be between 1.1 eV and 1.4 eV, depending on the composition of the alloy. For infrared optics considerations, the long wavelength cutoff is determined by lattice vibrations. It is known that the lattice absorption for silicon occurs at 18 microns. The first harmonic is at 9 microns. The lattice absorption for gallium arsenide occurs at 37 microns and the first harmonic is at 18.5 microns. Thus intrinsic gallium arsenide is transparent in the desired 8 to 12 micron region. Therefore, an alloy of silicon and gallium arsenide should remain transparent in the desired region so long as the alloy is less than 50% silicon and the gallium arsenide lattice structure prevails.

It will be recognized that the above considerations relate to theoretical properties of intrinsic materials. Intrinsic properties, however, are not readily achievable. For example, in gallium arsenide the materal is doped to trap residual carriers. Accordingly, to achieve the desired optical properties, the alloy of the invention may be doped with suitable materials such as chromium, iron, cobalt or the like which are conventionally used to achieve semi-insulating properties in gallium arsenide. The doping level required will be determined by the composition of the alloy and the residual carriers resulting from impurities.

From the foregoing it will be observed that various alloy compositions of silicon and gallium arsenide may be formed to produce infrared transmissive window panels which have highly desirable physical as well as optical characteristics. The alloy composition may be varied as desired to obtain specific physical and optical characteristics by varying the gallium arsenide to silicon ratio so long as silicon constitutes less than 50% of the alloy. The material may be doped as required to obtain intrinsic properties.

It is to be understood that although the invention has been described with particular reference to specific embodiments thereof, the forms of the invention shown and described in detail are to be taken as the preferred embodiments of same, and that various changes and modifications may be resorted to without departing from the spirit and scope of the invention as defined by the appended claims.

What is claimed:

1. A composition of matter comprising a unitary body of single phase crystalline alloy of silicon and gallium arsenide.

2. A composition of matter as set forth in claim 1 wherein silicon comprises from about 5 to about 50 atomic percent of said alloy.

3. A composition of matter comprising a unitary body of single phase crystalline alloy of silicon and gallium arsenide which is substantially transmissive in the region of 8 to 12 microns.

4. A composition of matter as defined in claim 3 including a doping impurity selected from the group consisting of chromium, iron and cobalt.

5. A window panel substantially transparent to radiation in the 8 to 12 micron region comprising a single phase crystalline alloy of silicon and gallium arsenide.

6. The method of forming an alloy of silicon and gallium arsenide comprising the steps of:

(a) placing gallium, arsenic and silicon in the atomic ratio desired in the alloy in a container, (b) replacing environmental gas in said container with an inert gas at slightly less than atmospheric pressure and sealing said container, (c) uniformly heating said container to a temperature of about 1300° C., and (d) cooling said container until the contents thereof form a solid material.

* * * * *